US008245984B2

(12) United States Patent
Wientges et al.

(10) Patent No.: US 8,245,984 B2
(45) Date of Patent: Aug. 21, 2012

(54) ADJUSTMENT DEVICE IN RAILROAD SWITCHES

(75) Inventors: Bernd Wientges, Constance (DE); Frank Meyer, Stockach (DE)

(73) Assignee: Schwihag AG, Taegerwilen (CH)

( * ) Notice: Subject to any disclaimer, the term of this patent is extended or adjusted under 35 U.S.C. 154(b) by 95 days.

(21) Appl. No.: 12/745,738

(22) PCT Filed: Dec. 23, 2008

(86) PCT No.: PCT/EP2008/011059

§ 371 (c)(1),
(2), (4) Date: Jun. 28, 2010

(87) PCT Pub. No.: WO2009/083230

PCT Pub. Date: Jul. 9, 2009

(65) Prior Publication Data

US 2010/0270436 A1 Oct. 28, 2010

(30) Foreign Application Priority Data

Jan. 3, 2008 (DE) ..... 10 2008 003 152
Dec. 4, 2008 (DE) ..... 10 2008 060 229

(51) Int. Cl.
*E01B 7/00* (2006.01)

(52) U.S. Cl. ..... 246/451

(58) Field of Classification Search ..... 246/415 R, 246/416, 430, 443, 448–453, 382; 238/281, 238/285

See application file for complete search history.

(56) References Cited

U.S. PATENT DOCUMENTS

| | | | | |
|---|---|---|---|---|
| 5,195,703 | A | 3/1993 | Kais | |
| 5,222,700 | A | 6/1993 | Kais | |
| 6,464,177 | B1 * | 10/2002 | Heim | 246/453 |
| 7,654,491 | B2 | 2/2010 | Steinmann | |
| 7,766,283 | B2 * | 8/2010 | Lesemann et al. | 246/453 |

FOREIGN PATENT DOCUMENTS

| | | | |
|---|---|---|---|
| DE | 4324883 | A | 2/1995 |
| DE | 19502105 | A | 7/1996 |
| EP | 0624508 | A | 11/1994 |
| EP | 1020341 | A | 7/2000 |
| EP | 0723901 | A | 4/2002 |

OTHER PUBLICATIONS

Hanni, W "Weichenstellsystem in Kastenschwelle" *Signal + Draht-*,Telzlaff erlag GmbH, Darmstadt, Germany vol. 86, No. 9, Sep. 1, 1994.

* cited by examiner

*Primary Examiner* — S. Joseph Morano
*Assistant Examiner* — Zachary Kuhfuss
(74) *Attorney, Agent, or Firm* — Andrew Wilford

(57) ABSTRACT

The invention relates to a device for shifting switch rails (6) associated adjustably with stock rails (7) or mobile frog tongues in railroad switches, configured as a latch or vertical clasp closure, comprising locking catches (4) which are activated by means of a cam or slide rod (5*a*, 5*b*), and closure pieces (3) and tongue attachments (2), wherein each locking catch (4) is pivotably supported in a tongue attachment (2) and the switch rail (6) is connected detachably to the tongue attachment (2). An improved and simpler adjustment option is to be created for such a device. For this, the cam or slide rod (5*a*, 5*b*) is vertically height-adjustable via a multi-edge body (9) mounted detachably in both closure pieces (3).

12 Claims, 4 Drawing Sheets

ADJUSTMENT DEVICE IN RAILROAD SWITCHES

CROSS REFERENCE TO RELATED APPLICATIONS

This application is the US-national stage of PCT application PCT/EP2008/011059, filed 23 Dec. 2008, published 9 Jul. 2009 as WO2009/083230, and claiming the priority of German patent application 102008003152.6 itself filed 3 Jan. 2008 and German patent application 102008060229.9 itself filed 4 Dec. 2008, whose entire disclosures are herewith incorporated by reference.

FIELD OF THE INVENTION

The invention relates to a switch motor for shifting switch blades or frog tongues relative to stock rails in railroad switches, configured as a vertical or pawl-type closure, comprising latch pawls that are actuated by a cam or slide rod, and rail is mounts and blade mounts, each latch pawl being pivotal in a respective blade mount to which the switch blade is detachably connected.

BACKGROUND OF THE INVENTION

As latch for switch tongues, for example, closures consisting of a blade mount, a rail mount, a latch pawl, and cam rods are well known and described (see DE 195 02 105 and EP 1 488 979 [U.S. Pat. No. 7,564,491]).

Installation and adjustment of the closures must be possible in a simple and fast manner. This requires a closure whose parts can be preset prior to installation in such a manner that complicated alignment of the closure during installation is eliminated.

In a solution known from EP 0 624 508, the rail mount is clamped to the foot of the stock rail. However, during assembly of the latch closure, in addition, the rail mount has to be readjusted in a complicated manner with a profile compensation rod to compensate for thickness tolerances of the stock rail foot. An additional adjustment of the distance between tongue and stock rail is carried out with an eccentric bolt located in the catch.

It is known from EP 0 723 901 and DE 195 02 105 to bolt rather than clamp the rail mount with the web of the stock rail. An additional adjustment is carried out by an eccentric and roller. With the eccentric, the distance between the cam rod and the bottom side of the stock rail foot can be adjusted. An additional is adjustment between the tongue and the stock rail is carried out analogously by an eccentric bolt located in the closure, as already described above. The main disadvantage of this solution is the bores in the stock rail. That is because the bores must be aligned with the bore in the tongue foot or tongue web (for fastening the blade mount). Otherwise, the result is a malfunction. In particular after changing the tongues, alignment of the bores can only be achieved with great effort. The roller has the disadvantage that it can wear circumferentially and thus has to be replaced after a certain operating time.

OBJECT OF THE INVENTION

The object of the invention is to avoid the described disadvantages for a closure of the above mentioned type and to provide improved and simpler adjustability.

SUMMARY OF THE INVENTION

This object is solved according to the invention in that the cam or slide rods are vertically height-adjustable by polygonal bodies detachably mounted in the rail mounts. By integrating the polygonal body, which can rotate or turn about its longitudinal axis, into the rail mounts, it is possible to clamp the rail mounts directly and without additional compensation elements such as, for example a profiled compensation rod, onto the stock rail foot. During height adjustment, the cam or slide rod rests on a flat upper side of the polygonal body that is preferably configured in the form of a square. In case the supporting, flat, upper side of the square body wears down because of frequent height adjustments, the square sleeve can be rotated about its longitudinal axis in a simple manner so that one of the three fresh flat upper sides becomes the contact surface. Compared to the prior-art height-adjusting roller body that has to be replaced immediately in case of heavy wear of the surface, the polygonal body can be used significantly longer, whereby maintenance and service intervals for the switches can be considerably extended.

Further, by means of the flat support surface between the cam rod and the cube or square, the surface pressure is considerably reduced, in particular with respect to the roller body.

One configuration of the invention provides that the vertical height adjustment of the cam or slide rod can be effected by rotating the polygonal or square body that, for this purpose, can be mounted on an eccentric or an eccentrically supported axle. Here, it is recommended that, according to a proposal of the invention, the polygonal body is provided with a central or eccentric axial though-hole. In this manner within a rail mount or with the same rail mount, different stock rail profile combinations and tongue profile combinations can be adjusted or adapted to one another. Then, the eccentric shaft or eccentrically supported shaft serves only for fine adjustment of the spacing between the cam or slide rod and the stock rail foot. Moreover, the support surfaces of the square body or polygonal body can be coated differently to meet different operating conditions.

BRIEF DESCRIPTION OF THE DRAWING

Further details and features of the invention are described in the following description of an embodiment of the invention shown in the drawings. Therein:

In FIG. 1, an actuator 1 of a railroad switch for shifting switch closures 1*a* and 1*b* is shown. Each switch closure 1*a* and 1*b* has a blade mount 2, a rail mount 3 and a latch pawl 4 (see FIGS. 2 and 3).

DETAILED DESCRIPTION

The simultaneous, oppositely directed displacement of the two switch closures 1*a* and 1*b* is effected by two identical cam- or slide-rod halves 5*a* and 5*b* that are integrally secured to one another by a connector 5*c*. An actuating rod is coupled to the connector 5*c* and is moved by a servomotor not shown here. By movement of the cam or slide rod 5*a*, 5*b*, which are guided in or ride on the rail mounts 3, and their interaction with the latch pawls 4, the switch closures 1*a* and 1*b* can be opened (1*a*) or closed (1*b*).

Figure 1:
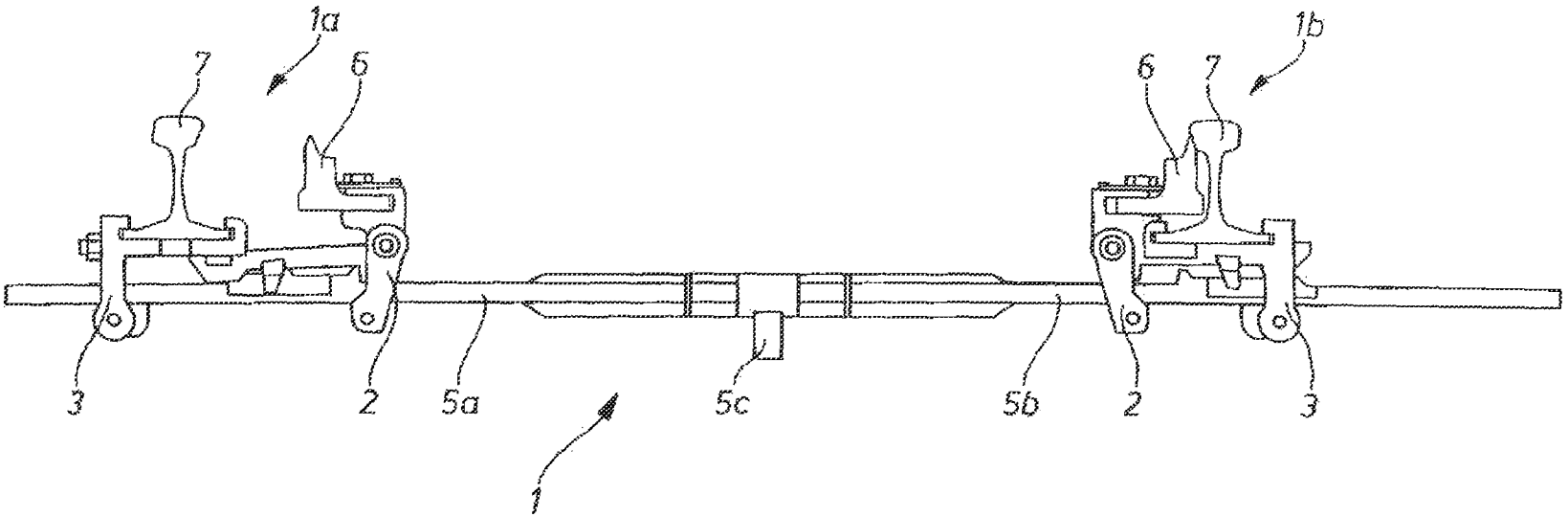
FIG. 1 is a schematic overall view of a railroad switch comprising an actuator for shifting switch closures configured as latches, the left closure is shown in the open position and the right closure in the closed position.
Figure 2:
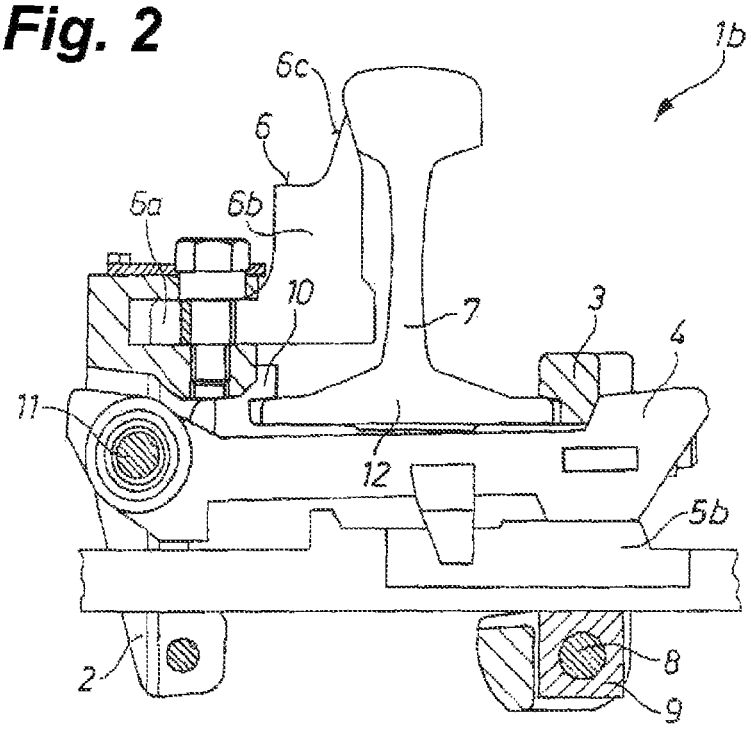
FIG. 2 is a detail view of the closed right latch closure

In FIG. 2, as a detail, the closed switch closure 1*b* is shown. The switch blade 6 has a foot 6*a*, a web 6*b*, and a head 6*c* and is braced against a stock rail 7.

Figure 3:
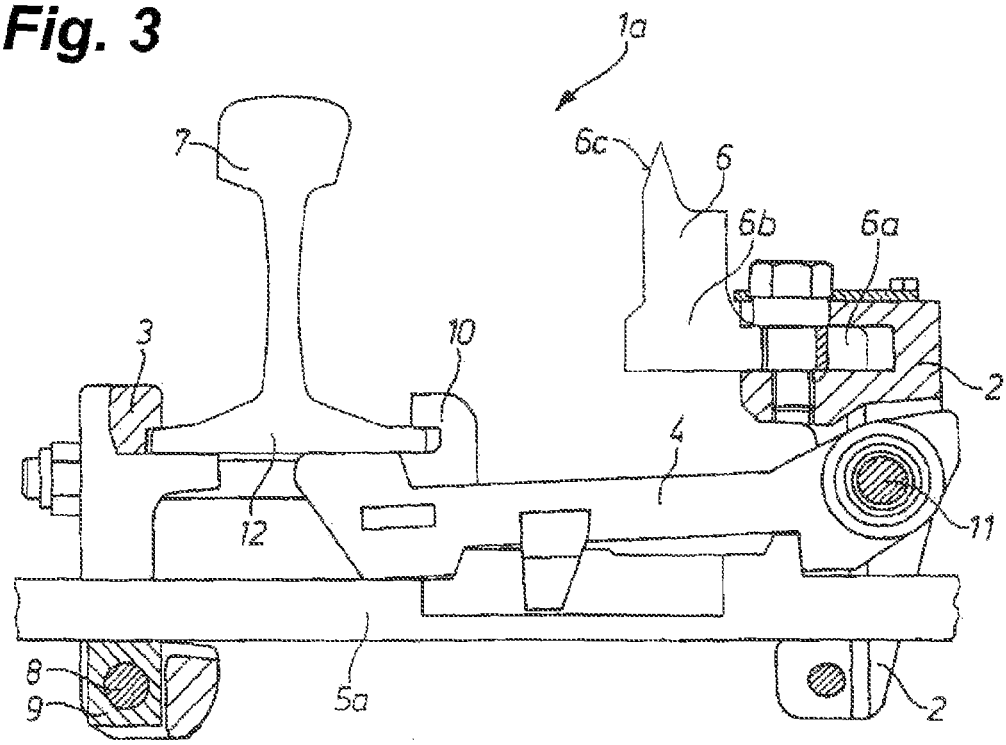
FIG. 3 is a detail view of the open left latch closure with the switch blade spaced from the stock rail.

FIG. 3 shows, as a detail, the open switch closure 1*a* where the switch blade 6 is spaced from the stock rail 7 by a suitable distance, the so-called tongue span.

Figure 4:
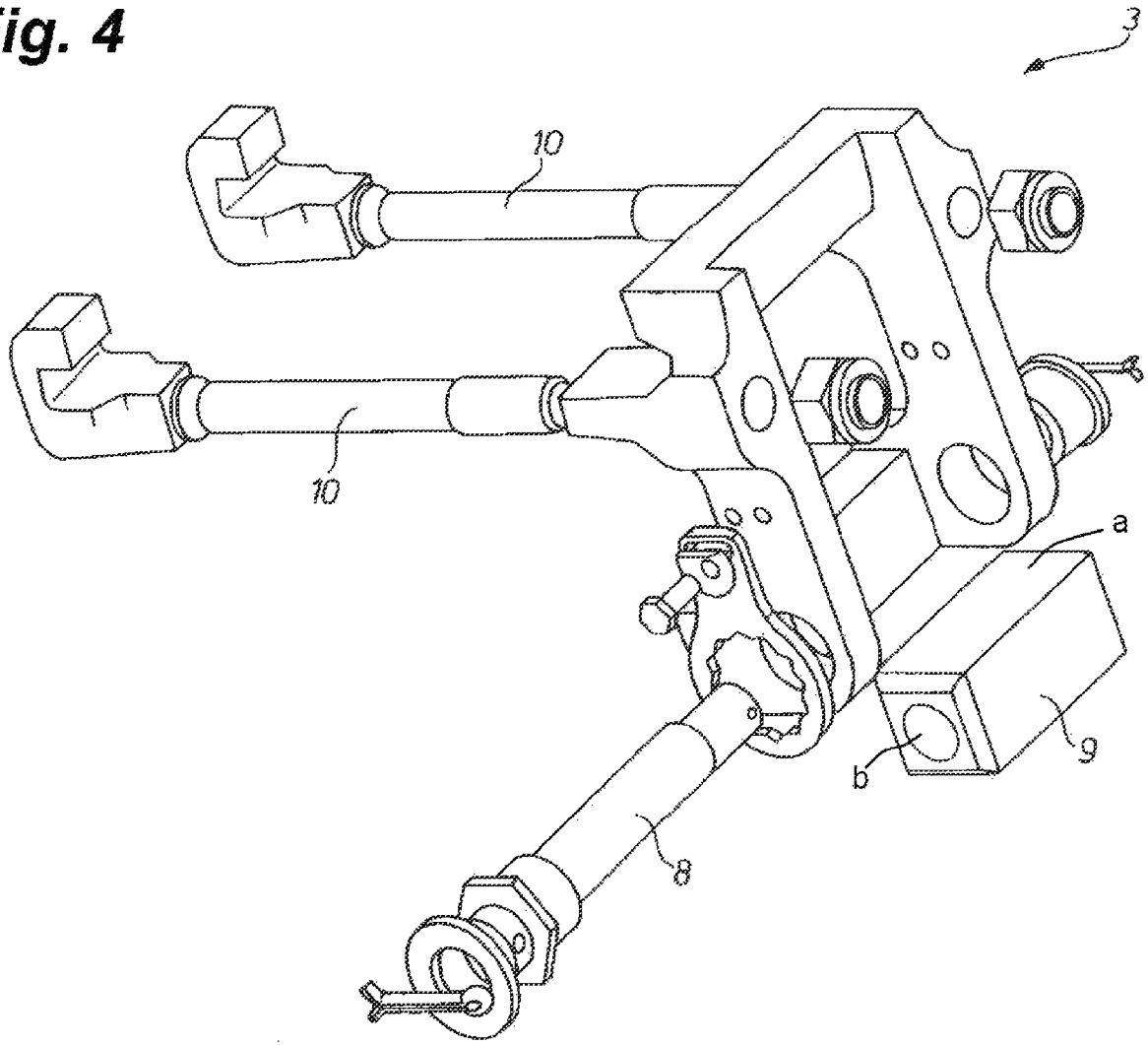
FIG. 4 is a perspective exploded view of the rail mount as a detail of the latch closure.

FIG. 4 shows, as a detail, the rail mount 3 of the switch closures 1*a* and 1*b*. At its lower side closer to the track bed, a square body 9 is supported by a shaft 8 that can if necessary be eccentric. The cam or slide rod 5*a*, 5*b* used for controlling or operating the actuator 1 abuts in the rest position as well as when moving the changeover process on a flat upper surface a of the square body 9. When using an eccentric shaft 8, its rotation results in an increasing or decreasing vertical adjustment of the square body 9 that allows a simple height adjustment of the cam or slide rod 5*a*, 5*b*.

The height adjustment allows the rail mount 3 to be secured in a simple manner to the stock rail 7 by two clamps 10 without the need of further alignment work. Horizontal displacement of the rail mount 3, which is required due to potential thickness tolerances of the stock rail foot 12, is compensated for by a sufficiently large eccentric 11 in the bearing of the blade mount 2 for the latch pawl 4.

The square body 9 in this embodiment is provided with an eccentric bore b, so that different combinations of stock rails and point profiles can be adapted for by the rail mount 3 or by the same rail mount 3. In this case, the eccentric shaft 8 is only used for fine adjustment of the distance between the cam or slide rod 5*a*, 5*b* and the stock rail foot 12.

Figure 5:
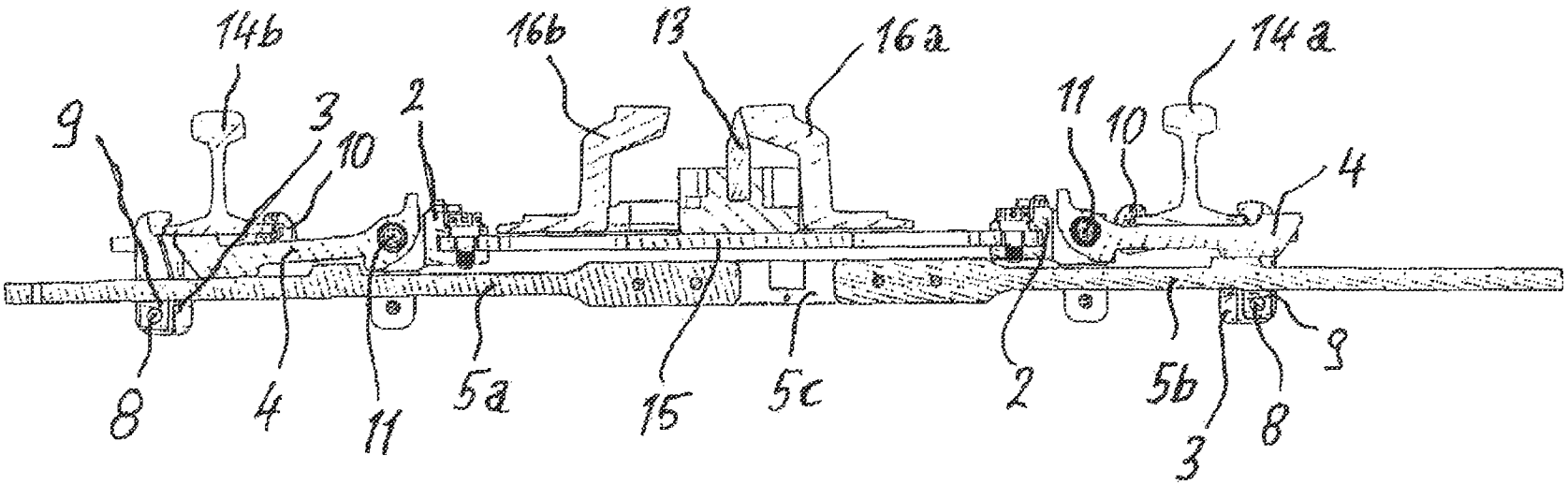
FIG. 5 is a longitudinal section through the actuator for shifting a movable frog tongue with rail mounts according to FIG. 4 fastened to auxiliary rails.

FIG. 5 shows, as an example, the use of such rail mounts 3 for shifting a movable frog tongue 13. Here, the rail mounts 3 are fastened or secured to auxiliary rails 14*a* or 14*b*. The blade mounts 2 are both fastened to a connecting or carrier plate 15 that carries the frog point or tongue 13 and that, upon actuation of the cam rod 5*a*, 5*b*, moves below wing rails 16*a* and 16*b*, which are complementary to the auxiliary rails 14*a* and 14*b*, into the respective end positions in which the frog tongue 13 abuts either against the wing rail 16*a* or the wing rail 16*b*, as shown in FIG. 5 for the right wing rail 16*a*.

The latch pawl 4 locks accordingly to the right auxiliary rail 14*a* while, in this position, the left auxiliary rail 14*b* is not influenced by its associated latch closure 4. The structure and the function of the rail mounts 3, which comprise the polygonal bodies 9 supported on the shafts 8, do not differ from the mode of operation described in connection with the FIGS. 1 to 4.

The invention claimed is:

1. A device for shifting switch blades associated adjustably with stock rails or mobile frog tongues in railroad switches, configured as a vertical or pawl-type closure, comprising latch pawls that are actuated by a cam or slide rod, and rail mounts and blade mounts, each latch pawl being pivotal in a respective blade mount in which the switch blade is detachably connected, wherein the cam or slide rods are vertically height-adjustable via respective square bodies detachably mounted in the rail mounts.

2. The device according to claim 1, wherein the square body is mounted on an eccentric or an eccentrically supported shaft.

3. The device according to claim 2, wherein the square body is provided with a central or eccentric, axial throughhole.

4. The device according to claim 1, wherein for shifting a movable frog tongue, the rail mount is fastened to an auxiliary rail.

5. In combination with a pair of transversely spaced, longitudinally horizontally extending, and generally fixed stock rails and a switch blade or frog transversely and horizontally shiftable therebetween, a switch assembly comprising:

respective rail mounts fixed to the stock rails;

an actuating rod extending transversely through both of the rail mounts;

a removably mounted polygonal-section body on each of the rail mounts having a plurality of faces each engageable upward with the rod for supporting the rod and vertically orienting the rod relative to the respective rail mount;

a pair of blade mounts releasably fixed to the switch blade or frog and each associated with a respective one of the stock rails;

a respective latch pawl pivoted on each of the blade mounts; and a respective coupling formation associated with each of the latch pawls and fixed on the rod for alternately shifting each of the blade mounts and the respective latch pawl between a closed position closely juxtaposed with and locked by the pawl to the respective stock rail and an open position spaced from the respective stock rail.

6. The combination defined in claim 5 wherein each of the rail mounts has a horizontally and longitudinally extending shaft, each polygonal-section body having a longitudinally throughgoing bore through which the respective shaft extends.

7. The combination defined in claim 6 wherein the body is of square section.

8. The combination defined in claim 6 wherein each shaft has eccentric parts, can be rotated about its axis in the respective mount and locked in a plurality of angularly offset positions, and on rotation vertically shifts the respective body.

9. The combination defined in claim 8 wherein one of the parts of each of the shafts is journaled in the respective rail mount and the other part of each of the shafts is journaled in the bore of the body.

10. The combination defined in claim 6, further comprising respective abutment formations on the rail mount preventing rotation of the respective bodies on the respective shafts.

11. The combination defined in claim 5 wherein the coupling formations are each a cam engageable transversely with the respective latch pawl.

12. The combination defined in claim 11 wherein each of the coupling formation is limitedly transversely shiftable relative to the respective pawl.

* * * * *